US010315239B2

(12) United States Patent
Stockter et al.

(10) Patent No.: US 10,315,239 B2
(45) Date of Patent: Jun. 11, 2019

(54) FORMING TOOL FOR THE PRODUCTION OF A HOLLOW COMPONENT, AND METHOD FOR OPERATING THE FORMING TOOL

(71) Applicants: Benteler Automobiltechnik GmbH, Paderborn (DE); Benteler Maschinenbau GmbH, Bielefeld (DE)

(72) Inventors: Robert Stockter, Hannover (DE); Volker Rackow, Paderborn (DE); Walter Herrmann, Bad Wuennenberg (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 15/888,010

(22) Filed: Feb. 3, 2018

(65) Prior Publication Data

US 2018/0221931 A1 Aug. 9, 2018

(30) Foreign Application Priority Data

Feb. 3, 2017 (DE) ..... 10 2017 102 139

(51) Int. Cl.
*B21D 9/04* (2006.01)
*B21D 5/01* (2006.01)
(Continued)

(52) U.S. Cl.
CPC ..... *B21D 9/04* (2013.01); *B21D 5/015* (2013.01); *B21D 37/00* (2013.01); *B21D 53/88* (2013.01); *B21C 37/08* (2013.01)

(58) Field of Classification Search
CPC ... B21D 5/01; B21D 9/04; B21D 9/12; B21D 11/0203
(Continued)

(56) References Cited

U.S. PATENT DOCUMENTS

2004/0003645 A1 1/2004 Viegener et al.
2013/0020834 A1* 1/2013 Diersmann ..... B21D 26/033 296/193.06
(Continued)

FOREIGN PATENT DOCUMENTS

CN 1438923 A 8/2003
DE 102011051965 A1 1/2013
(Continued)

OTHER PUBLICATIONS

German Office Action for Application No. 10 2017 102 139.6, dated Nov. 17, 2017, 10 pp.
(Continued)

*Primary Examiner* — Debra M Sullivan
(74) *Attorney, Agent, or Firm* — Hauptman Ham, LLP

(57) ABSTRACT

A forming tool and a method of operating thereof for producing a hollow component by sheet-metal forming is disclosed having an upper tool and a lower tool, a mandrel that is driven into the hollow component to be formed and an auxiliary mandrel that is repositionable relative to the mandrel are positioned on the upper tool. The mandrel and the auxiliary mandrel are coupled to the upper tool by one spring-elastic actuation element in such a manner that the mandrel, when the upper tool is being lowered, is driven into the hollow component to be formed and comes to bear therein. A further lowering of the upper tool causes a compression of the coupling element, and the auxiliary mandrel carrying out a movement relative to the mandrel and being driven further into the hollow component.

17 Claims, 10 Drawing Sheets

(51) Int. Cl.

| | |
|---|---|
| ***B21D 37/00*** | (2006.01) |
| ***B21D 53/88*** | (2006.01) |
| *B21C 37/08* | (2006.01) |

(58) Field of Classification Search
USPC ..... 72/51, 52
See application file for complete search history.

(56) References Cited

U.S. PATENT DOCUMENTS

| | | | | |
|---|---|---|---|---|
| 2016/0325330 | A1 | 11/2016 | Nitta et al. | |
| 2018/0021829 | A1* | 1/2018 | Sato | B21D 5/015 428/586 |

FOREIGN PATENT DOCUMENTS

| | | | |
|---|---|---|---|
| DE | 102011116714 | A1 | 4/2013 |
| WO | 2015133464 | A1 | 9/2015 |

OTHER PUBLICATIONS

Office Action for Chinese Application No. 201810104169.X dated Jan. 28, 2019; 13pp.
Office Action for Japanese Application No. 2018012808 dated Mar. 5, 2019; 9pp.
Office Action for Korean Application No. 10-2018-0013047 dated Mar. 21, 2019; 10pp.

* cited by examiner

A-A
12
12

B-B
10

FORMING TOOL FOR THE PRODUCTION OF A HOLLOW COMPONENT, AND METHOD FOR OPERATING THE FORMING TOOL

RELATED APPLICATIONS

The present application claims the priority of German Application Number 10 2017 102 139.6, filed Feb. 3, 2017, the disclosure of which is hereby incorporated by reference herein in its entirety.

TECHNICAL FIELD

The present invention relates to a forming tool for the production of a hollow component by sheet-metal forming.

The present invention furthermore relates to a method for operating the forming tool.

The present invention furthermore relates to a forming tool of a hollow component by sheet-metal forming.

BACKGROUND

It is known in the prior art for components, in particular motor vehicle components, to be produced by sheet-metal forming. To this end, a sheet-metal blank is provided, this in most instances being a sheet-steel blank. Light-metal materials such as, for example, aluminum alloys or similar, can also be used.

To this end, the respective sheet-metal blank is formed to a three-dimensionally shaped sheet-metal formed component between an upper tool and a lower tool. Such sheet-metal components in most instances have a shell-shaped configuration.

In order for hollow components, in particular hollow components that are closed in the cross section, to now be produced by means of sheet-metal forming methods, U-to-O forming is known from the prior art. To this end, a sheet-metal blank is likewise first provided. This sheet-metal blank is formed in such a manner that said sheet-metal blank has a U-shaped configuration in the cross section. In a subsequent forming step, the outwardly directed or projecting, respectively, legs of the U-shape are then further formed so as to generate a cross-sectional O-shape, consequently a hollow profile that is closed in the cross section.

U-shapes and O-shapes in the context of the invention does not mean that a cross-sectional U and an O have to be necessarily adhered to. U-shaped is to be interpreted in such a wide manner that a hollow profile that is unilaterally open is produced, and O-shaped to be interpreted in such a wide manner that a hollow profile that is closed in the cross section is produced, the latter as opposed to the letter O however also potentially having other closed geometries.

In order for cross sections that are mutually dissimilar across the longitudinal profile to now be able to be formed, in the case of O-shapes mandrels are driven into particularly the end side of the hollow component to be produced and withdrawn upon completion of the forming procedure.

A forming tool in which the end-side plug-in mandrels in conjunction with a U-to-O forming procedure can also be configured in segments is known from DE 10 2011 051 965 A1, for example.

SUMMARY

It is an object of the present invention to provide a forming tool and a method for operating the forming tool which compared with forming tools known from the prior art can be operated with low complexity in terms of the driving-in of mandrels.

The aspect of the device of the object is achieved by a forming tool for the production of a hollow component by sheet-metal forming.

An aspect of the method of the object is achieved by a method for the production of a hollow component.

A further achievement of the aspect of the device of the object provides a forming tool.

Advantageous variants of design embodiments of the present invention are described.

The forming tool for the production of a hollow component by sheet-metal forming has an upper tool and a lower tool. A mandrel that is driven into the hollow component to be formed and an auxiliary mandrel that is repositionable relative to the mandrel are disposed on the upper tool. The mandrel and the auxiliary mandrel are by way of in each case one spring-elastic actuation means preferably coupled to the upper tool. The mandrel when the upper tool is being lowered is driven into the hollow component to be formed and at least in part comes to bear therein. The hollow component to be formed at this stage is in particular a U-shaped preformed preform component, consequently a profile that is unilaterally open in the cross section.

A further lowering of the upper tool leads to a compression of the spring-elastic actuation means between the mandrel and the upper tool.

Once the mandrel has come to bear, a relative movement of the auxiliary mandrel in relation to the mandrel is carried out by further lowering the upper tool. To this end, in particular the auxiliary mandrel is coupled to the upper tool by way of an adjustment mechanism, in particular a coupling bar. The auxiliary mandrel is driven into the hollow component to be formed in particular in a movement direction at an angle in relation to the press stroke direction of the upper tool.

The forming procedure from the U-shaped preform component to the O-shaped hollow component is simultaneously carried out by the further lowering of the upper tool. A hollow component having mutually dissimilar cross-sectional geometries in the longitudinal direction is generated by driving in the mandrel and the auxiliary mandrel into an end-side region of the hollow component to be formed.

Cross-sectional geometries which are mutually dissimilar in the longitudinal direction can be generated herein during the one forming procedure.

On account of the spring-elastic actuation means which in particular is a gas pressure damper or a spring element, the mandrel comes to bear on the preform component already before the upper tool has reached the lower dead center. A further lowering of the upper tool then leads to a compression of the spring-elastic actuation means between the mandrel and the upper tool. The auxiliary mandrel, by virtue of the adjustment mechanism, can carry out a movement relative to the mandrel during this compression, and is thus driven laterally or at the end side, respectively, into the hollow component to be formed, in particular at an angle of more than 10° in relation to the press stroke direction. This movement direction upon completion of the forming procedure is then carried out in the reversed sequence such that the auxiliary mandrel is first driven out of the end side of the formed hollow component, wherein a closed cross-sectional geometry has been produced at the end side at least in longitudinal portions and the auxiliary mandrel is nevertheless able to be withdrawn.

The mandrel per se furthermore has an external contour which corresponds to the internal contour of the hollow component to be produced, at least in terms of an end-side longitudinal portion.

An incline, hereunder also referred to as an inclined face, is provided in the mandrel per se, wherein the auxiliary mandrel when carrying out the movement relative to the mandrel slides across the inclined face. The inclined face in particular runs at an angle of more than 10°, preferably more than 20°, in relation to the press stroke direction of the upper tool or of the forming tool, respectively. By further lowering the upper tool in the press stroke direction, the auxiliary mandrel thus carries out a relative movement which is not exclusively directed in the press stroke direction but by virtue of the inclined face is simultaneously at least partially also oriented in the direction transverse to the press stroke direction.

The auxiliary mandrel is furthermore particularly preferably at least in portions disposed in the mandrel per se. The mandrel in particular has an opening which penetrates the mandrel, wherein the auxiliary mandrel is disposed in the penetrating opening. On one side of the opening, the auxiliary mandrel is coupled to the upper tool by way of the adjustment mechanism. On the other side of the opening, the auxiliary mandrel carries out the movement relative to the mandrel and thus, at the lower dead center of the upper tool, in part protrudes from the mandrel.

The auxiliary mandrel is coupled to the upper tool by way of an adjustment mechanism, also referred to as the coupling mechanism. In particular, a spring-elastic actuation means, for example a spring or a gas pressure damper, is likewise conjointly incorporated here. The coupling mechanism can operate according to the principle of a knuckle joint, for example. The spring-elastic actuation means furthermore ensures that in the case of an unexpected blockage or, depending on the layout of the driving-in movement of the auxiliary mandrel, a further lowering of the upper tool does not lead to undesirable deformations but is compensated for by a compression of the spring-elastic actuation means. The spring-elastic actuation means of the mandrel as well as of the auxiliary mandrel is preferably driven passively by the movement of the forming tool.

The method according to the invention, which is carried out on the forming tool described above, provides that a hollow component that in the cross section is closed at least in longitudinal portions, is produced by means of U-to-O forming from a planar or flat sheet-metal blank, respectively, by the following method steps:

- providing a sheet-metal blank, and preforming to a preform component that is U-shaped in the cross section;
- placing the preform component in a forming tool;
- lowering the upper tool, wherein a mandrel is driven into the preform component and comes to bear therein;
- wherein by further lowering the upper tool an auxiliary mandrel relative to the mandrel is driven further into the preform component; and
- that the preform component by the further lowering of the upper tool by O-forming is formed to the hollow component.

In one alternative, the U-shaped preforming can also already be carried out in the forming tool.

The method is in particular distinguished in that the auxiliary mandrel during forming is driven in a movement direction into the end side of the hollow component to be produced and in the subsequent opening is also driven out of the hollow component again. Cross-sectional geometries that are mutually dissimilar in longitudinal portions can thus be generated at least in an end portion by way of the mandrel and the auxiliary mandrel. However, the end portion can account for up to 40%, in particular up to 30%, of the entire length of the hollow component.

When the forming tool is being opened upon completion of the forming procedure, the auxiliary mandrel is first driven out of the formed hollow component. The mandrel is initially held in the hollow component on account of the relaxation of the spring-elastic actuation means. Upon completion, or else briefly prior to the completion, of the driving-out procedure of the auxiliary mandrel from the hollow component, the mandrel is also driven out of the hollow component by further lifting the upper tool. Canting of the auxiliary mandrel, which at least in part is also driven into the hollow component in a manner transverse to the press stroke direction, is thus avoided.

Longitudinal chassis beams, pillars, or roof posts, as well as impact absorbers or crash boxes for motor vehicle bodies can be produced in particular by the forming tool and the production method for a hollow component according to the invention. It would also be conceivable for the forming to be carried out as hot-forming and press-hardening such that a sheet-metal blank, or preform components, respectively, that has/have previously been heated to the austenitizing temperature is/are finally formed and hardened to the hollow component in the forming tool.

A further aspect of the device of the object is achieved by a forming tool for the production of a hollow component by sheet-metal forming. To this end, an auxiliary mandrel that is driven into the hollow component to be formed is disposed on the upper tool, wherein the auxiliary mandrel is coupled to the upper tool by way of a spring-elastic actuation means. All features mentioned above also apply to this forming tool, albeit with the difference that a mandrel is not already at least partially driven into the hollow component to be formed in the lowering movement of the upper tool. This aspect of the solution provides that only the auxiliary mandrel is driven into the end side of the hollow component to be formed. To this end, the auxiliary mandrel is likewise at least in part driven into the end side of the hollow component to be formed, prior to the lower dead center of the upper tool being reached. The driving in movement is carried out substantially at an angle in relation to the lowering movement. A further lowering of the upper tool then forms the U-shape of the preform component to an O-shape. The auxiliary mandrel that is driven in at the end side enables a desired cross-sectional contour. A further lowering for forming the U-shape to the O-shape is compensated for by the spring-elastic actuation means between the auxiliary mandrel and the upper tool in such a manner that said actuation means is compressed.

An entrainment element that is provided on the upper tool ensures that the auxiliary mandrel, when the upper tool is being opened or lifted, respectively, is driven out in relative manner from the end side of the hollow component that is produced so as to be closed in the cross section.

To this end, the auxiliary mandrel is preferably mounted so as to be movable in relative manner in a tool receptacle. The tool receptacle per se is mounted so as to be movable in relative manner on the upper tool. The tool receptacle, when the upper tool is being lowered, preferably comes into contact with, or comes to bear on, a counter bearing, respectively. The spring-elastic actuation means between the tool receptacle and the upper tool is then compressed, this simultaneously leading to a relative movement of the auxiliary mandrel that is mounted in the tool receptacle, such that said auxiliary mandrel is driven into the end side of the hollow component to be formed.

BRIEF DESCRIPTION OF THE DRAWINGS

The forming tool described here can be carried out according to the method described above, and/or can be combined with the forming tool described at the outset.

Further advantages, features, properties and aspects of the present invention are the subject matter of the description hereunder. Preferred variants of design embodiments are explained in the schematic figures. Said figures serve for the ready understanding of the invention. In the figures.

The same reference signs are used for the same or similar components in the figures, even when a repetition of the description is omitted for the sake of simplicity.

DETAILED DESCRIPTION

Figure 1:
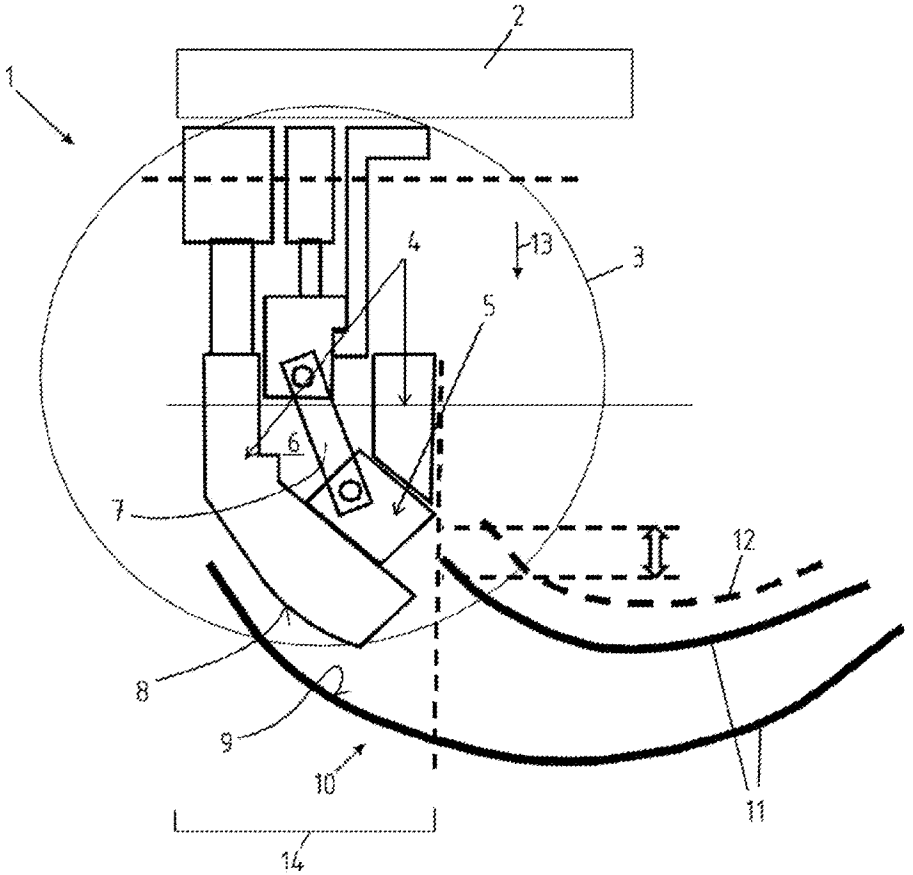
FIGS. 1 to 4 show a forming tool according to the invention, and a method sequence for the production of a hollow component.

FIG. 1 shows a schematic side view of a forming tool 1 according to the invention. A support unit 3 is suspended from an indicated upper tool 2. The support unit 3 is configured from a mandrel 4, from an auxiliary mandrel 5, and from a respective coupling. The auxiliary mandrel 5, by way of a coupling mechanism 7, is coupled so as to be movable in relative manner in an opening 6 of the mandrel 4.

Figure 2:
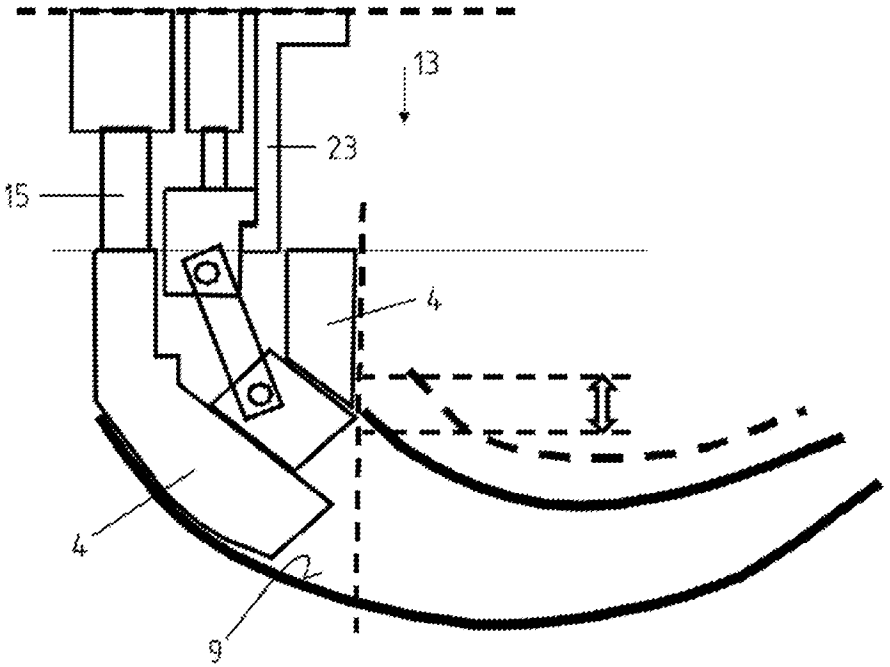

The mandrel 4 per se has an external contour 8 which corresponds to the internal contour 9 of the hollow component 10 to be produced. The hollow component 10 is illustrated by the solid lines 11 in a longitudinal sectional view. The dashed line 12 shows part of the preform component after the U-forming step and prior to the O-forming step. The mandrel 4 on account of a lowering movement of the upper tool 2 in the press stroke direction 13 is driven into an end 14 of the hollow component 10 to be produced in such a manner until the mandrel 4 comes to bear on the internal contour 9 of the hollow component 10, as is illustrated in FIG. 2.

Figure 3:
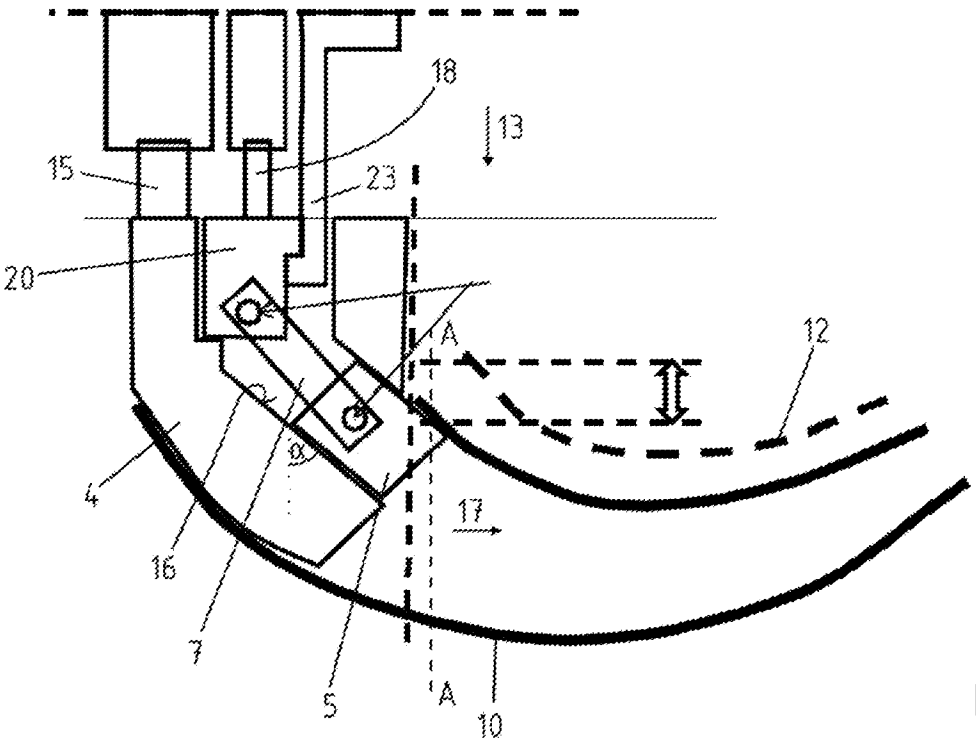

A further lowering of the upper tool 2 in the press stroke direction 13 leads to a compression of a spring-elastic actuation means 15 of the mandrel 4, as is illustrated in FIG. 3. The mandrel 4 per se is thus positioned in the hollow component 10 to be produced.

However, the auxiliary mandrel 5 by virtue of the coupling mechanism 7 carries out a movement relative to the mandrel 4. Here, an inclined face 16 is disposed in the mandrel 4, or in the opening 6 of the mandrel 4, respectively, wherein the inclined face 16 is oriented at an angle $\alpha$ of in particular more than 1°, preferably more than 10°, in relation to the press stroke direction 13. The auxiliary mandrel 5 thus is driven in at least partially in a lateral manner, or in a transverse direction 17, respectively, into the end 14 of the hollow component 10 to be produced.

The upper tool 2 is now further lowered in the press stroke direction 13 such that the spring-elastic actuation means 15 of the mandrel 4, as well as a spring-elastic actuation means 18 of the auxiliary mandrel 5, are further compressed without the mandrel 4 and the auxiliary mandrel 5 carrying out any further movement. To this end, a detent 19, or a detent cam, can be provided, for example, such that a further inward pushing movement of the auxiliary mandrel 5 is restricted.

The coupling mechanism 7 can be suspended from a repositioning block 20, for example, which comes to bear on the detent 19. The actuation means 18 of the auxiliary mandrel 5 can thus also be compressed by a further lowering movement of the upper tool 2 in the press stroke direction 13, without the auxiliary mandrel 5 carrying out any further relative movement. However, the dashed line 12 is simultaneously formed by a forming surface (not illustrated in more detail) of the upper tool 2 such that the hollow component 10 is formed so as to have a closed cross-sectional geometry.

When the forming tool 1 is now opened, the auxiliary mandrel 5 initially carries out a relative movement up to the vertical V, and is thus moved out of the end 14 of the hollow component 10 having the closed cross section such that the mandrel 4 is moved out of the hollow component 10 by further opening in the direction opposite to the press stroke direction 13.

The auxiliary mandrel 5, or the repositioning block 20 of the auxiliary mandrel 5, respectively, can furthermore be disposed on a lifting angle 23 such that the relative movement of the auxiliary mandrel 5 can be influenced. In particular, the position of the auxiliary mandrel 5 in relation to the vertical direction, prior to the lowering procedure, consequently the driving-in direction in the transverse direction, can be set by the lifting angle 23. To this end, the lifting angle 23 per se is in particular configured so as to be settable or adjustable, respectively. The position of the auxiliary mandrel 5 relative to the mandrel 4 is set by setting the lifting angle 23.

Figure 4:
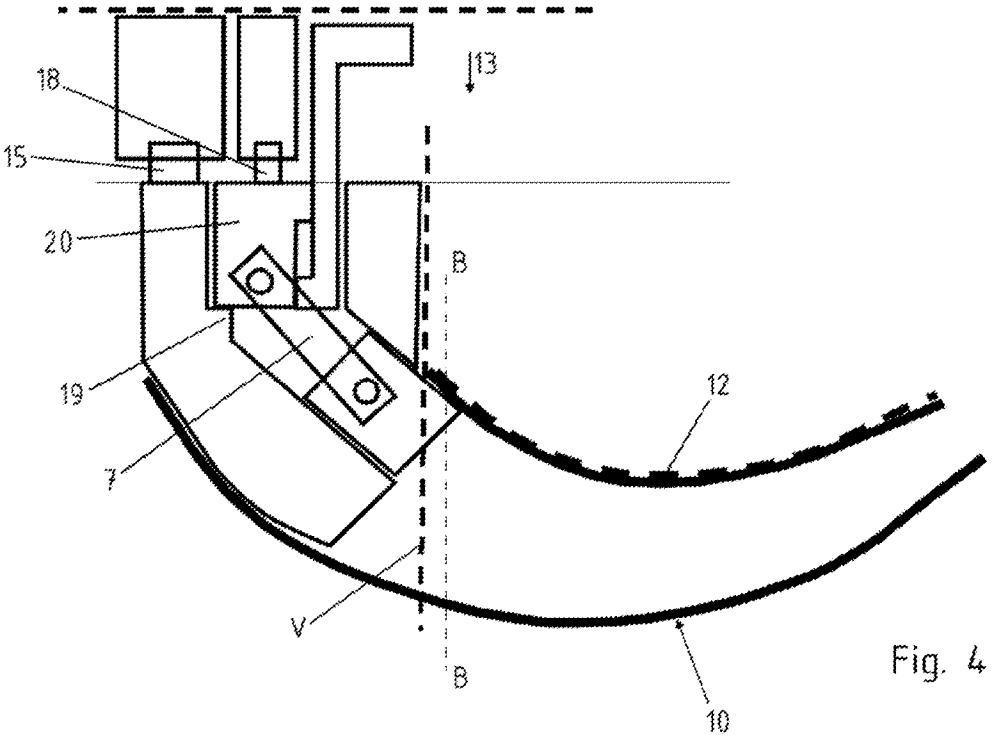
Figures 5A, 5B, 5C:
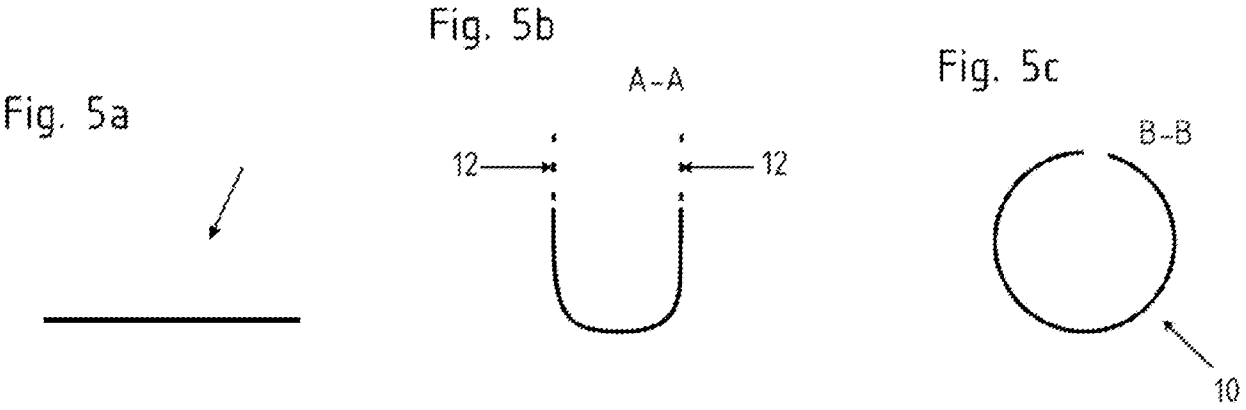
FIGS. 5*a* to 5*c* show various cross-sectional views through a hollow component prior to, during, and after forming.

Mutually dissimilar cross-sectional geometries are illustrated in FIGS. 5 *a*) to *c*). A planar sheet-metal blank 21 is initially provided according to FIG. 5 *a*), said sheet-metal blank 21 being formed to the preform component 22 according to FIG. 5 *b*). The outer end of each leg of the U-shaped preform component 22 is illustrated here by the dashed line 12; however, said preform component 22 is of one piece and a materially integral component part of the sheet-metal blank 21, said dashed line 12 serving only as a comparison for the dashed lines from FIGS. 1 to 3. In a further lowering movement the section line B-B from FIG. 4 is generated, and the hollow component 10 that is closed in the cross section is produced by O-forming. The cross-sectional geometry can be simultaneously set in a corresponding manner by the auxiliary mandrel 5 that is driven in.

Figure 6:
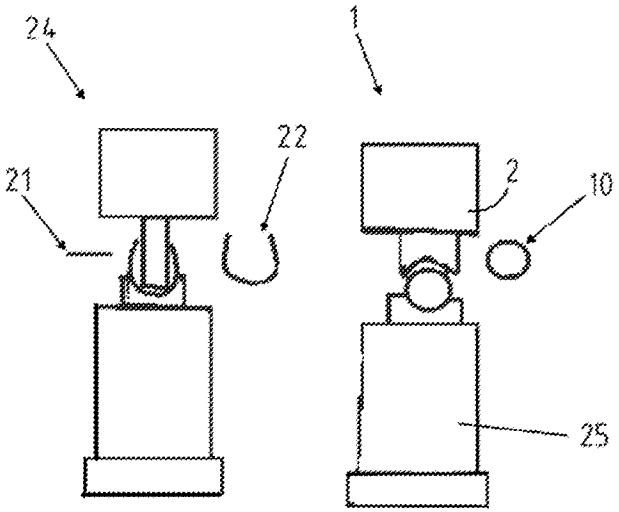
FIG. 6 shows a schematic side view of forming tools for U-to-O forming, having an upper tool and a lower tool.
Figure 7:
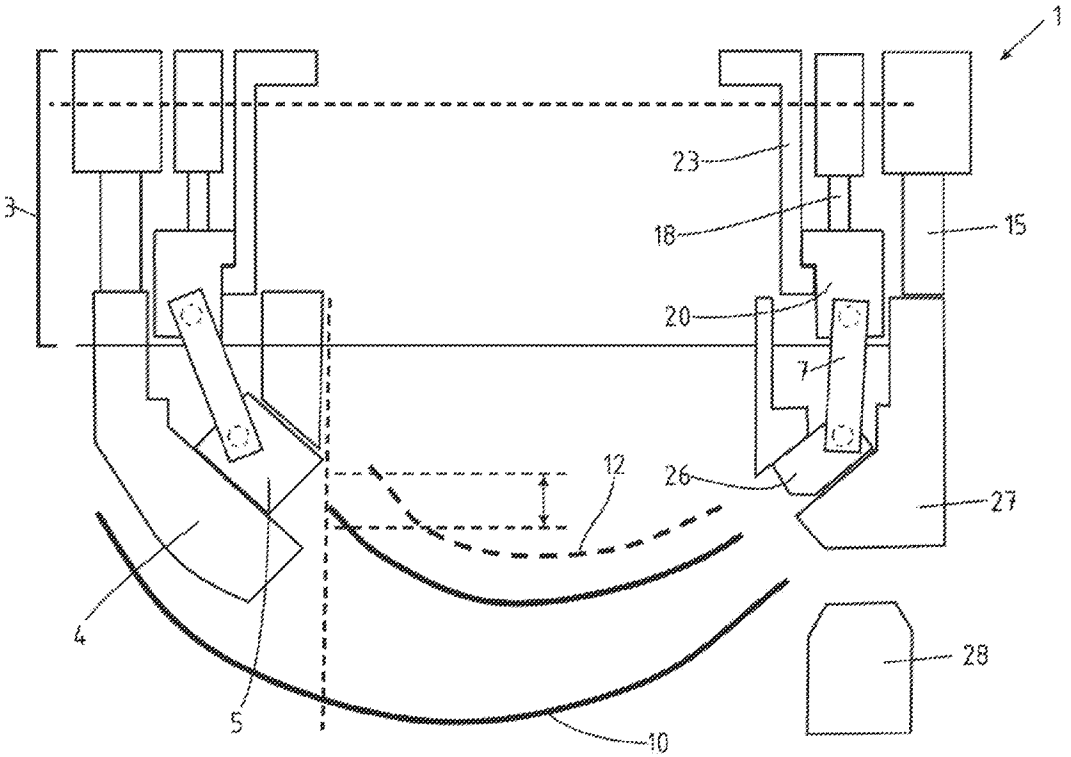
FIGS. 7 to 10 show an alternative variant of a design embodiment of a forming tool according to the invention, and a method sequence for the production of a hollow component.
Figure 8:
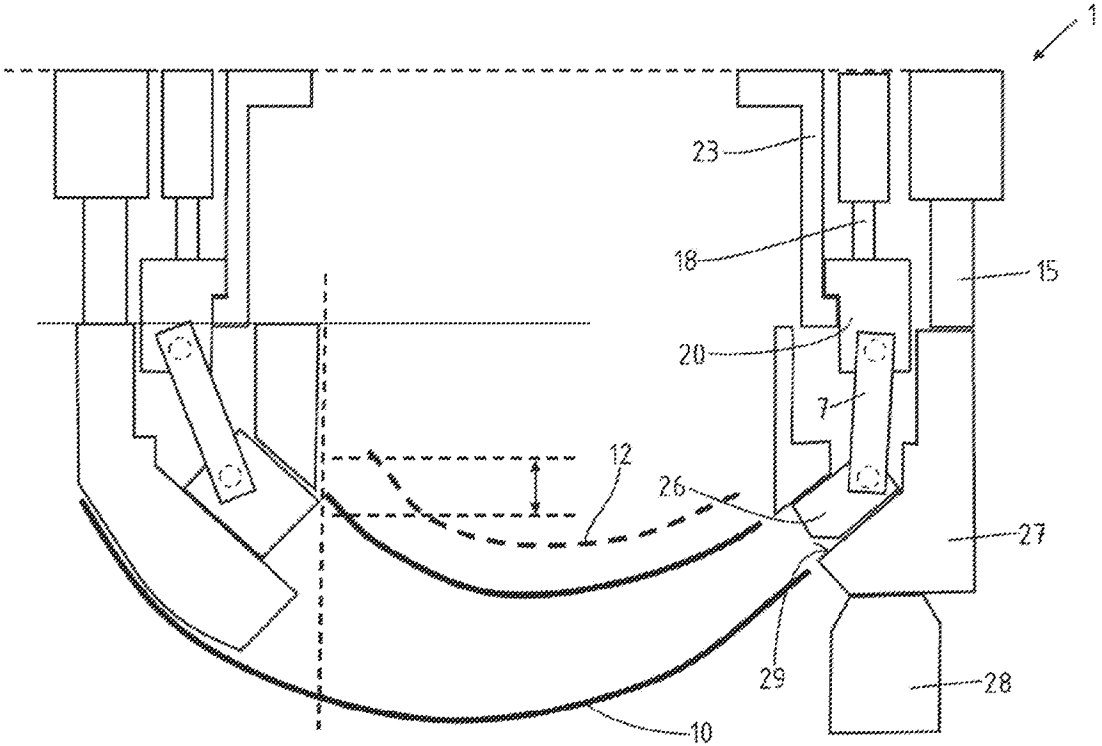
Figure 9:
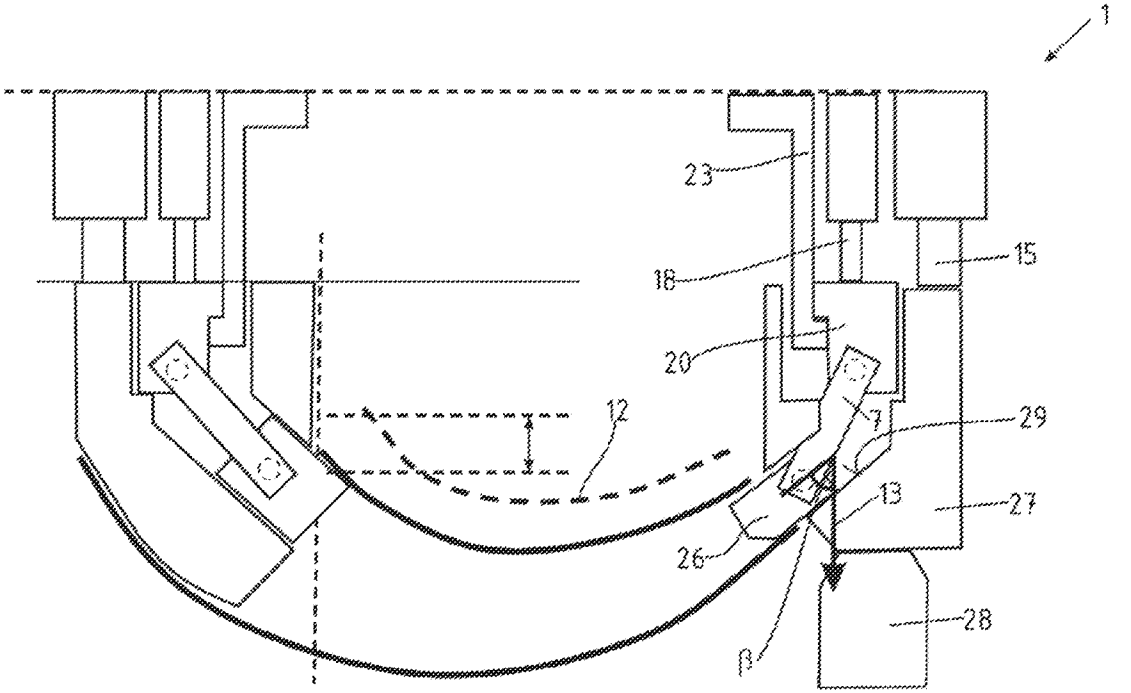
Figure 10:
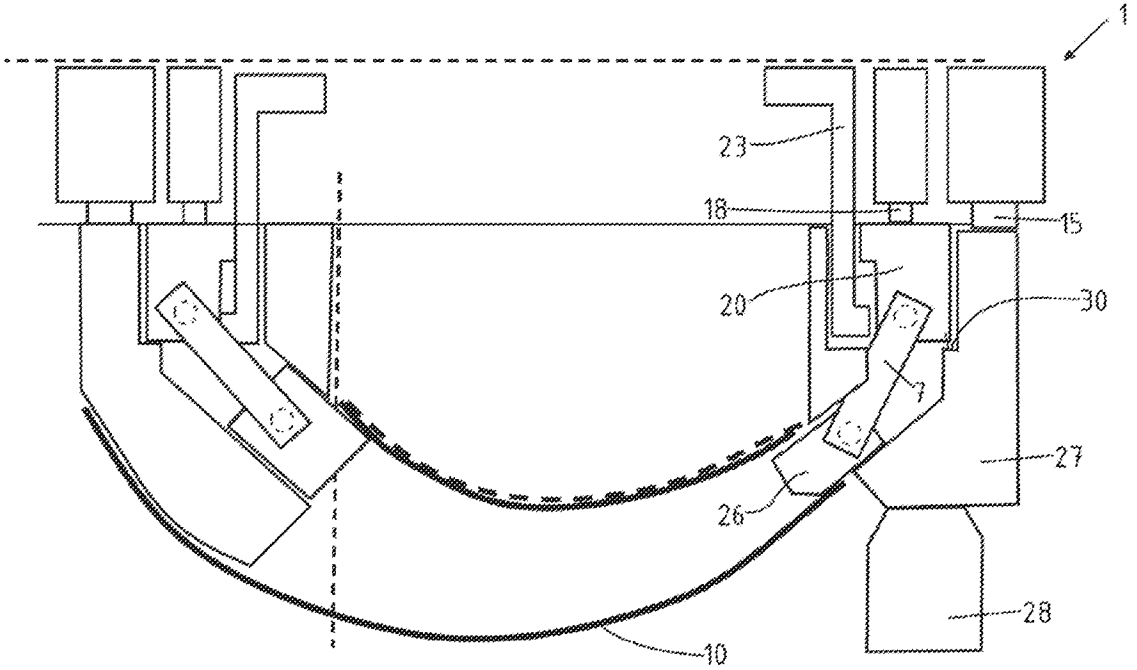

FIG. 6 on the left side shows a forming tool 24 for the production of a U-shaped preform component 22. The forming tool 1 according to the invention for carrying out an O-forming procedure is shown on the right side. First, the U-shaped preform component 22 is produced from the sheet-metal blank 21, said U-shaped preform component 22 is subsequently placed into the forming tool 1, and the hollow component 10 that is closed in the cross section is produced by O-forming. The support unit 3, illustrated in FIGS. 1 to 4, having the mandrel 4 and the auxiliary mandrel 5 is suspended from the upper tool 2 of the forming tool 1.

The forming tool 1 furthermore has a lower tool 25. The hollow component 10 is shaped between the upper tool 2 and the lower tool 25.

FIG. 7 to FIG. 10 show a forming tool 1 which is used in a preferred refinement or an alternative variant of design embodiment to the forming tool 1 shown in FIG. 1 to FIG. 4. The forming tool 1 according to FIGS. 7 to 10 herein can be embodied either alone by way of the variant illustrated, in each case relating to the right image plane. Alternatively however, the forming tool 1 can also be used as a forming tool 1 combined with the unit composed of the mandrel 4 and the auxiliary mandrel 5 on the left image plane, and the unit composed of the auxiliary mandrel 26, the tool receptacle 27 and the counter bearing 28 on the right image plane. Herein, the respective auxiliary mandrel 5, 26 is driven into either end side of a hollow component 10 to be formed.

Reference is made to the description of the figures pertaining to FIGS. 1 to 4 for the unit on the left image plane.

The unit on the right image plane is described hereunder. The auxiliary mandrel 26 according to the right image side is mounted so as to be movable in relative manner in a tool receptacle 27. In particular, the auxiliary mandrel 26 by way of a coupling mechanism 7 is mounted on a repositioning block 20. The repositioning block 20 is coupled to the upper tool 2 by way of a spring-elastic actuation means 18.

The tool receptacle 27 comes to bear on the counter bearing 28 when the upper tool 2 is lowered. A further lowering of the upper tool compresses the spring-elastic actuation means 15 of the tool receptacle 27. The auxiliary mandrel 26, moved in relative manner in the tool receptacle 27, by way of an incline 29 is repositioned at an angle β in relation to the press stroke direction 13, and is driven into the hollow component 10 to be formed.

A lifting angle 23 which is movable relative to the repositioning block 20 is furthermore provided. The lifting angle 23 is preferably coupled directly to the upper tool 2. When the upper tool 2 is being lifted, after having reached the lower dead center illustrated in FIG. 10, the repositioning block 20 of the auxiliary mandrel 26 is thus entrained by the lifting angle 23, wherein the tool receptacle 27 on account of the compressed spring-elastic actuation element 18 still bears on the counter bearing. On account thereof, the auxiliary mandrel 26 is initially withdrawn from the end 14 of the hollow component 10 formed. Lifting of the tool receptacle 27 is performed only once the auxiliary mandrel 26 has been withdrawn. To this end, the spring-elastic actuation element 15 of the tool receptacle 27 is preferably completely decompressed.

The unit that in relation to the image plane is illustrated on the right can be disposed alone in a forming tool 1 for the production of a hollow component 10. However, the unit can also be combined with the support unit 3 relating to the left image plane, such that driving into the hollow component 10 to be formed is performed from both ends 14.

The invention claimed is:

1. A forming tool for producing a hollow component by sheet-metal forming, the forming tool comprising:
- an upper tool and a lower tool;
- a mandrel;
- an auxiliary mandrel repositionable relative to the mandrel;
- a spring-elastic actuator; and
- an auxiliary spring-elastic actuator, wherein
- the mandrel and the auxiliary mandrel are coupled to the upper tool by the spring-elastic actuator and the auxiliary spring-elastic actuator, respectively,
- when the upper tool is being lowered toward the lower tool, the mandrel is configured to move into a preform component having a U-shaped cross section to bear on an internal surface of the preform component,
- when the upper tool is being further lowered toward the lower tool to compress the auxiliary spring-elastic actuator, the auxiliary mandrel is configured to move relative to the mandrel further into the preform component to form the hollow component.

2. The forming tool according to claim 1, wherein the mandrel has an external contour configured to correspond to an internal contour of the hollow component.

3. The forming tool according to claim 1, wherein the mandrel has an inclined face, and the auxiliary mandrel is configured to slide across the inclined face.

4. The forming tool according to claim 3, wherein the inclined face runs at an angle of 10 to 50 degrees, in relation to a press stroke direction of the upper tool in which the upper tool is configured to be lowered or lifted.

5. The forming tool according to claim 3, wherein the inclined face runs at an angle of 10 to 40 degrees, in relation to a press stroke direction of the upper tool in which the upper tool is configured to be lowered or lifted.

6. The forming tool according to claim 1, wherein the spring-elastic actuator is a gas pressure spring.

7. The forming tool according to claim 1, wherein the auxiliary mandrel is at least partially disposed in an opening of the mandrel.

8. The forming tool according to claim 1, wherein the auxiliary mandrel is coupled to the spring-elastic actuator by a coupling mechanism.

9. The forming tool according to claim 1, wherein the mandrel in a resting position at which the mandrel is not moved into the preform component is mounted so as to project in relation to the auxiliary mandrel.

10. A forming tool for producing a hollow component by sheet-metal forming, the forming tool comprising:
- an upper tool and a lower tool;
- an auxiliary mandrel; and
- an auxiliary spring-elastic actuator,
- wherein
- the auxiliary mandrel is coupled to the upper tool by the auxiliary spring-elastic actuator,
- when the upper tool is being lowered toward the lower tool, the auxiliary mandrel is configured to move into a preform component having a U-shaped cross section to bear on an internal surface of the preform component,
- when the upper tool is being further lowered toward the lower tool, the auxiliary spring-elastic actuator is configured to be compressed,
- the upper tool is openable, and
- when the upper tool is being opened,
  - the auxiliary mandrel is configured to move out of the formed hollow component,
  - the upper tool is configured to be further lifted to cause the auxiliary mandrel to be conjointly lifted with the upper tool, and
  - the auxiliary spring-elastic actuator is configured to be decompressed when the auxiliary mandrel is moved fully out of the formed hollow component.

11. The forming tool according to claim 10, further comprising a tool receptacle and a counter bearing, wherein
- the auxiliary mandrel is movable in a relative manner in the tool receptacle, the tool receptacle is coupled and moveable in a relative manner to the upper tool while incorporating the auxiliary spring-elastic actuator, and when the upper tool is being lowered to bear on the counter bearing, the counter bearing comes to bear on the tool receptacle before the upper tool reaches a lower dead center thereof.

12. The forming tool according to claim 10, further comprising a mandrel and a spring-elastic actuator, wherein the auxiliary mandrel is repositionable relative to the mandrel, the mandrel is coupled to the upper tool by the spring-elastic actuator, when the upper tool is being lowered toward the lower tool, the mandrel is configured to move into the preform component to bear on the internal surface of the preform component.

13. A method of producing a hollow component by a U-to-O forming tool, the method comprising:

providing a sheet-metal blank;

preforming the sheet-metal blank into a preform component having a U-shaped cross section;

placing the preform component in the forming tool, the forming tool including an upper tool and a lower tool, a spring-elastic actuator and an auxiliary spring elastic actuator, and a mandrel and an auxiliary mandrel repositionable relative to the mandrel, wherein the mandrel and the auxiliary mandrel are coupled to the upper tool by the spring-elastic actuator and the auxiliary spring-elastic actuator, respectively, lowering the upper tool toward the lower tool to move the mandrel into the preform component to bear on an internal surface of the preform component; and then further lowering the upper tool toward the lower tool to compress the auxiliary spring-elastic actuator and cause the auxiliary mandrel to move relative to the mandrel further into the preform component to form the hollow component.

14. The method according to claim 13, wherein the auxiliary mandrel is moved into the preform component from an end of the preform component in a movement direction, and an angle between at least a part of the movement direction and a press stroke direction of the upper tool in which the upper tool is lowered or lifted is more than 1 degree.

15. The method according to claim 13, further comprising opening the forming tool after forming the hollow component, wherein the auxiliary mandrel is moved into the preform component from an end of the preform component in a movement direction, and when the forming tool is being opened, the auxiliary mandrel is moved out in an opposite movement direction from the end of the preform component, and the mandrel is then lifted by the auxiliary spring-elastic actuator in a press stroke direction of the upper tool in which the upper tool is lowered or lifted.

16. The method according to claim 13, wherein the auxiliary mandrel is moved into the preform component from an end of the preform component in a movement direction, and an angle between at least a part of the movement direction and a press stroke direction of the upper tool in which the upper tool is lowered or lifted is more than 10 degrees.

17. The method according to claim 13, wherein the auxiliary mandrel is moved into the preform component from an end of the preform component in a movement direction, and an angle between at least a part of the movement direction and a press stroke direction of the upper tool in which the upper tool is lowered or lifted is more than 20 degrees.

* * * * *